US005394847A

United States Patent [19]

Kikuchi et al.

[11] Patent Number: 5,394,847

[45] Date of Patent: Mar. 7, 1995

[54] THROTTLE VALVE CONTROL APPARATUS OF VEHICLE

[75] Inventors: Toshiaki Kikuchi; Shosuke Suzuki, both of Okazaki, Japan

[73] Assignee: Nippondenso Co., Ltd., Kariya, Japan

[21] Appl. No.: 97,031

[22] Filed: Jul. 27, 1993

[30] Foreign Application Priority Data

Jul. 28, 1992 [JP] Japan ..... 4-220889

[51] Int. Cl.[6] ..... F02M 9/08

[52] U.S. Cl. ..... 123/339; 364/431.05

[58] Field of Search ..... 123/339, 399, 397; 364/431.05; 62/133

[56] References Cited

U.S. PATENT DOCUMENTS 5,031,595 7/1991 Heck et al. ..... 123/339
5,115,396 5/1992 Keegan ..... 123/399
5,191,531 3/1993 Kurosu et al. ..... 364/431.05
5,199,272 4/1993 Yamanaka et al. ..... 123/339
5,235,951 8/1993 Taguchi et al. ..... 123/397
5,307,776 5/1994 Unuvar et al. ..... 123/399
5,307,777 5/1994 Sasajima et al. ..... 123/399

FOREIGN PATENT DOCUMENTS 63-2845 1/1988 Japan .
64-11817 2/1989 Japan .

*Primary Examiner*—Raymond A. Nelli
*Attorney, Agent, or Firm*—Cushman, Darby & Cushman

[57] ABSTRACT

A throttle control system reliably determines failure of a throttle valve driving system. During engine idling, a throttle valve is opened and closed by an actuator. A central processing unit generates a pulse-like drive signal to the actuator through a back-up integrated circuit. When the frequency of the drive signal exceeds a predetermined value, the back-up integrated circuit determines that a failure in the central processing unit has occurred. Since this determination is based on the frequency of the drive signal, a driving system failure can be reliably detected even using pulse-like signals.

10 Claims, 7 Drawing Sheets

THROTTLE VALVE CONTROL APPARATUS OF VEHICLE

BACKGROUND OF THE INVENTION

1. Field of the Invention

The present invention relates to a throttle valve control apparatus of a vehicle and, more particularly, to a throttle valve control apparatus having a failure determining function of a throttle valve driving system.

2. Description of Related Art

As such a throttle valve control apparatus, for example, there is an apparatus disclosed in JP-B-64-11817. A failure of a driving circuit is detected when a drive signal to a motor built in an actuator for opening or closing a throttle valve is generated for over predetermined time period, where the magnitude of the predetermined time period, where the duration of the predetermined time period corresponds to a duration of a drive signal generated by a normally functioning system.

A control apparatus using a relay in a driving circuit of a stepping motor to drive a throttle valve has been disclosed in JP-U-63-2845.

In recent years, however, a computer has been used for control of a throttle valve. In a failure of such a computer, there is often a case where a number of drive pulses of a short time are generated. Therefore, when an elapsed time of the drive signal is merely detected as in the conventional apparatus, there is problem in that it is impossible to determine a failure when a pulse-like drive signal is generated at an abnormally high frequency.

On the other hand, even when the driving of the throttle valve is merely stopped after the occurrence of a failure was determined, the throttle valve is held at an abnormal opening degree and difficulties will occur in the subsequent operation of the vehicle.

SUMMARY OF THE INVENTION

An object of the present invention is to solve the above problems and it is an object of the invention to provide a throttle valve control apparatus which can reliably determine a failure of a throttle valve driving system that is controlled by a computer and which can return the throttle valve to a proper position after the occurrence of the failure was decided.

A preferred embodiment of the invention will now be described. In a throttle valve control apparatus for detecting an idling state of an engine of a vehicle and for controlling an opening degree of a throttle valve to a predetermined opening degree in the idling operation, the control apparatus comprises: actuator means for opening or closing the throttle valve; driving means for generating drive signals to the actuator means in a pulse-like manner; and failure determining means for determining that a failure has occurred in the driving means when frequency of the drive signals exceeds a predetermined value.

According to another preferred embodiment of the invention, a throttle valve control apparatus comprises: driving means for generating drive signals in a pulse-like manner to actuator means for opening or closing a throttle valve; drive instructing means for generating a drive instruction signal to the driving means; and failure determining means for comparing phases of the drive instruction signal and the drive signal, thereby determining that failure has occurred in the driving means when the two do not coincide.

According to still another embodiment of the invention, a throttle valve control apparatus comprises an actuator which opens and closes a throttle valve responsive to a pulse-like drive signal, driving means for generating the drive signal, and failure determining means for determining that a failure has occurred in the driving means. This determination is made when a pulse length of the drive signal exceeds a predetermined value. This predetermined value corresponds to the length of a drive signal generated by a normally operating system. When this determination is made, the failure determining means outputs an inverse operation signal to the actuator means. The length of the inverse operation signal is equal to the length of a pulse required to return the throttle valve to its state immediately prior to the erroneous drive signal.

The frequency of the drive signal is detected or a lack of coincidence of the phases between the drive instruction signal and the drive signal is detected, thereby determining a failure. Therefore, even in the case where the drive signals are generated in a pulse-like manner, the occurrence of a failure of the driving system can be reliably determined.

On the other hand, when the occurrence of a failure is decided, the actuator means is inversely operated by the pulse length just before the determination of the failure, so that the throttle valve is not held in a state of an abnormal opening degree.

DETAILED DESCRIPTION OF THE PREFERRED EMBODIMENT

Figure 1:
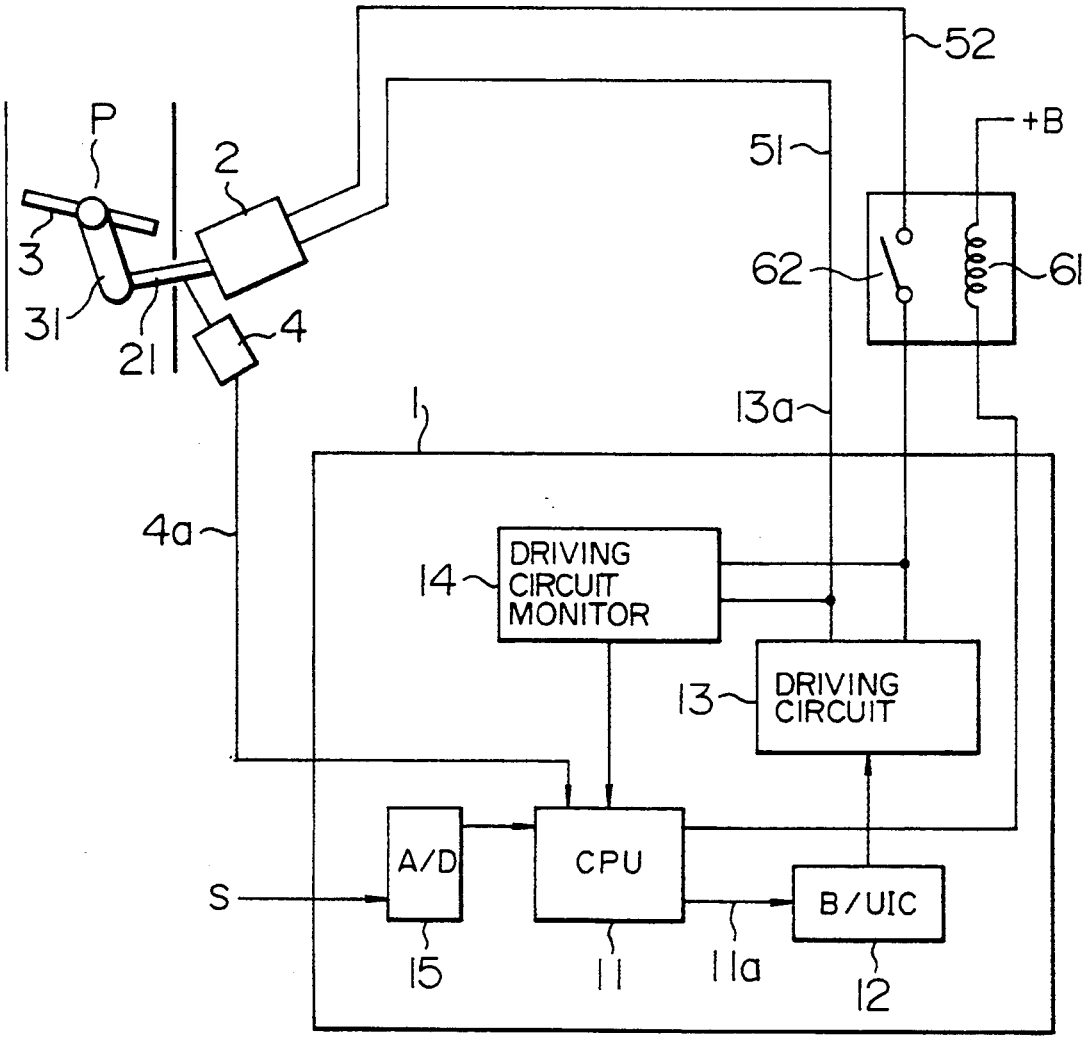
FIG. 1 is a block diagram showing a preferred embodiment of an apparatus according to the present invention.

FIG. 1 shows an example of a throttle valve control apparatus according to the present invention. This embodiment controls an opening degree of a throttle valve in an engine idling mode in which an acceleration pedal is released.

In the diagram, a throttle valve 3 is provided in an engine intake passage P. A throttle lever 31 provided for the throttle valve 3 is in contact with an edge of a plunger 21. When an acceleration pedal (not shown) is released, the throttle valve 3 is rotated in the closing direction by a spring force and the throttle lever 31 comes into contact with the plunger 21 and is stopped. In this instance, an idling switch 4 provided for the plunger 21 is made operative and generates an idle signal 4*a*.

The plunger 21 is extended or contracted in association with the forward or backward rotation of a motor built in the actuator 2, thereby changing an opening degree of the throttle valve 3 in the idling mode.

Two current supply lines 51 and 52 are led out from an electronic control unit (ECU) 1 and are connected to an actuator 2. A relay contact 62 is interposed in the current supply line 52.

The ECU 1 is constructed by a computer (CPU) 11, a backup (B/U) IC 12, a driving circuit 13, a driving circuit monitor 14, an A/D converter 15, and the like. An idle signal 4a is supplied to the CPU 11. Various kinds of signals (represented by S) such as an engine cooling water temperature signal, an air conditioner operation signal, a shift position sensor signal of a transmission, a vehicle velocity sensor signal, and the like are also supplied to the CPU 11 through the A/D converter 15.

The CPU 11 generates a drive instruction signal 11a to forwardly or reversely rotate a motor of the actuator 2 in a pulse-like manner. The signal 11*a* is supplied to the driving circuit 13 via the B/U IC 12. The B/U IC 12 monitors the drive instruction signal 11*a* and detects a failure of the CPU 11 and executes processes, which will be explained hereinlater. The driving circuit 13 amplifies the drive instruction signal 11*a*, thereby producing a drive signal 13*a* of the same shape as signal 11*a* and supplies the drive signal 13*a* to the actuator 2 through the current supply lines 51 and 52.

The current supply lines 51 and 52 are branched to the driving circuit monitor 14. The monitor 14 detects the level of the drive signal 13*a* and supplies a detection signal to the CPU 11. A relay coil 61 is connected between the CPU 11 and a relay power source +B.

Figure 2:
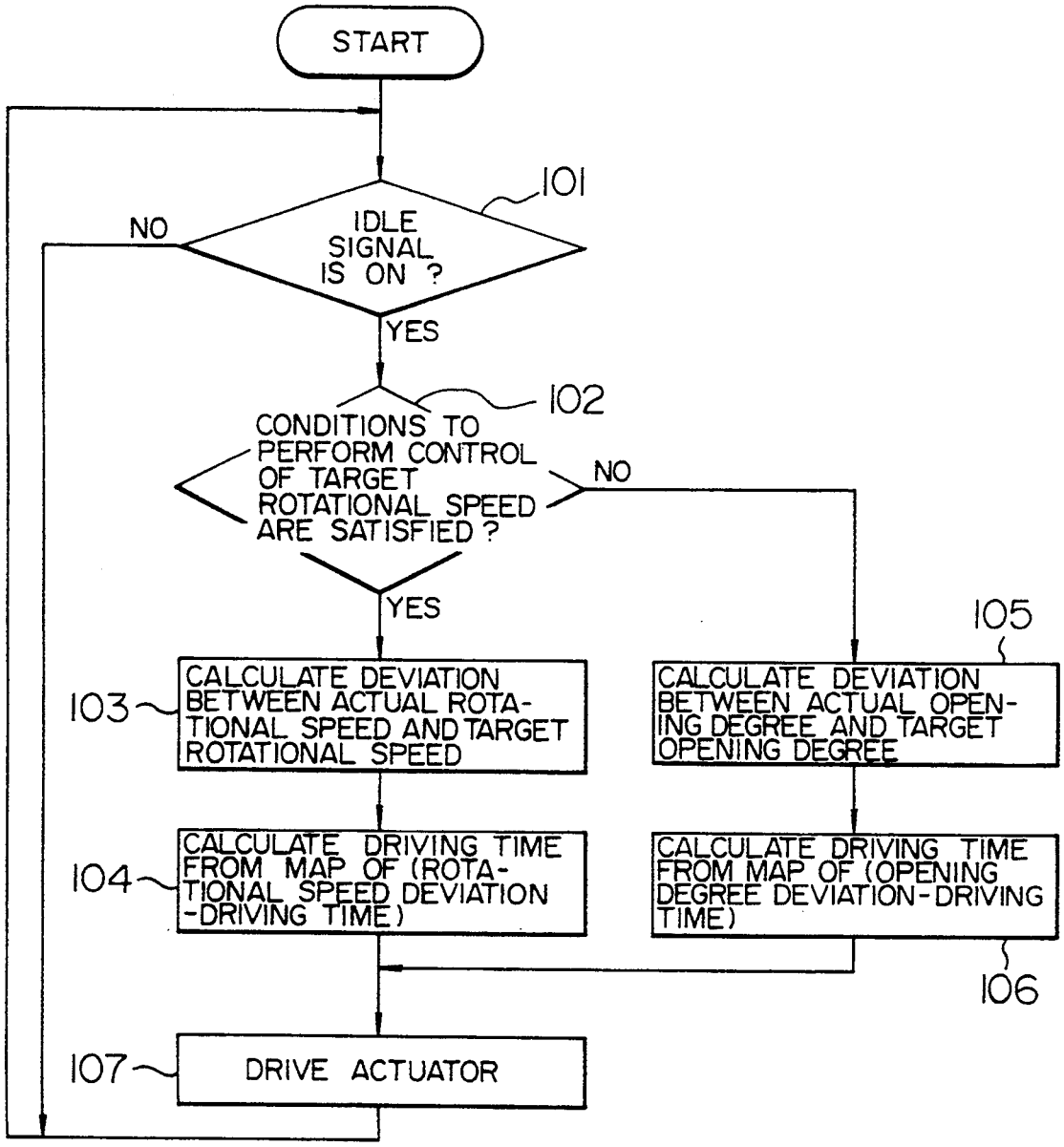
FIG. 2 is a flowchart for a drive control of an actuator according to the present invention.

FIG. 2 shows a control procedure of the throttle valve in the CPU. In step 101, a check is made to see if the idle signal 4*a* has been generated and the apparatus is in the idling mode or not. If YES, step 102 follows and a check is made to see if conditions to perform the control of a target rotational speed of the engine are satisfied or not. The conditions in this case indicate the following conditions: namely, a predetermined time period or longer has elapsed after the idling switch 4 was turned on from the off state; a vehicle velocity is equal to or lower than a predetermined value; a predetermined time has elapsed after external loads such as air conditioner and the like were turned on or off, where the predetermined time period is of sufficient length to ensure that the engine rotational speed is stable and the like. Namely, the above conditions indicate that the engine rotational speed is stable.

Figure 3:
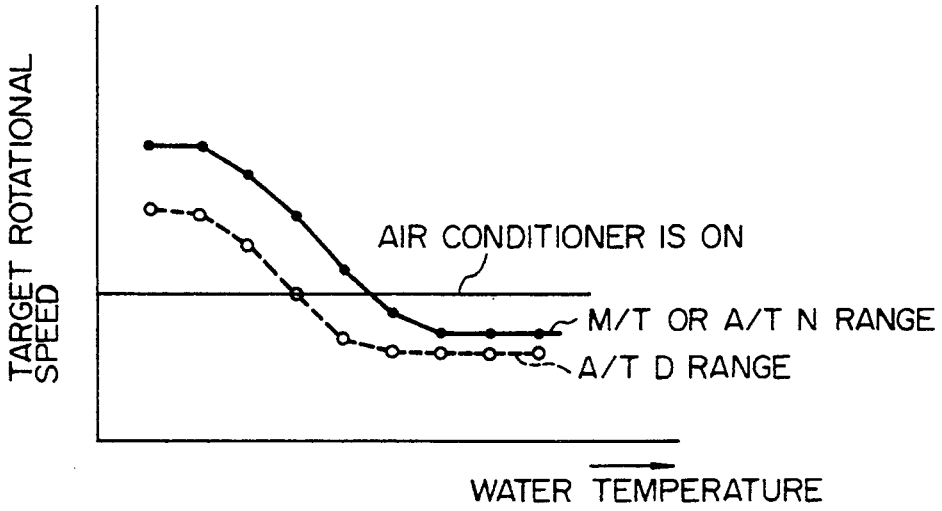
FIG. 3 is a graph showing characteristics of a target rotational speed of an engine depending on temperature of cooling water.

When the performing conditions for the control of the target rotational speed are satisfied, a deviation between the target rotational speed of the engine and the actual rotational speed is calculated in step 103. For instance, as shown in FIG. 3, the target rotational speed is determined by the correlation with the temperature of the engine cooling water while setting the shift position of a transmission to a parameter and has previously been stored as a map. A line indicative of an ON state of the air conditioner in the diagram indicates the lower limit of the target rotational speed in the case where the air conditioner is being operated.

Figure 4:
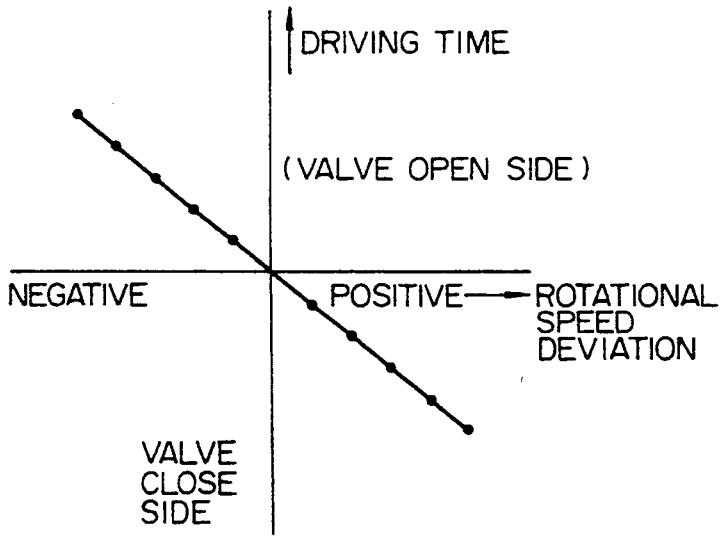
FIG. 4 is a graph showing the relation between the deviation of the rotational speed and the driving time of the actuator.

In step 104, on the basis of the deviation calculated in step 103, the driving time of the actuator 2 is calculated in accordance with the relation shown in FIG. 4 which has previously been stored as a map. In step 107, the drive instruction signal 11*a* is generated. The drive instruction signal 11*a* is set in a manner such that its elapsed time $T_D$ doesn't exceed a predetermined time period $T_M$ (for example, 100 msec) and that its period (corresponding to a frequency $F_D$) is not equal to or smaller than a predetermined period (namely, $F_D$ is not equal to or higher than a predetermined frequency). The predetermined time period $T_M$ corresponds to the duration of a drive signal generated by a normally functioning system.

Figure 5:
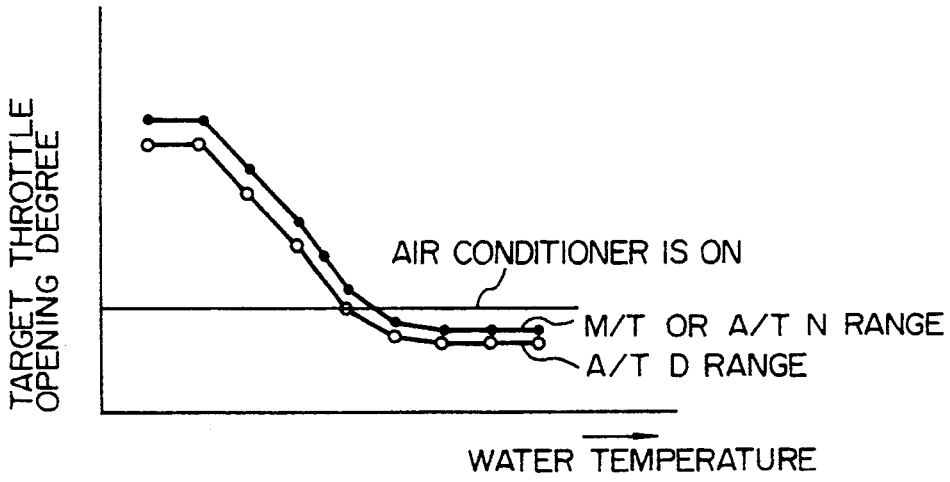
FIG. 5 is a graph showing characteristics of target opening degree of a throttle valve depending on the temperature of cooling water.
Figure 6:
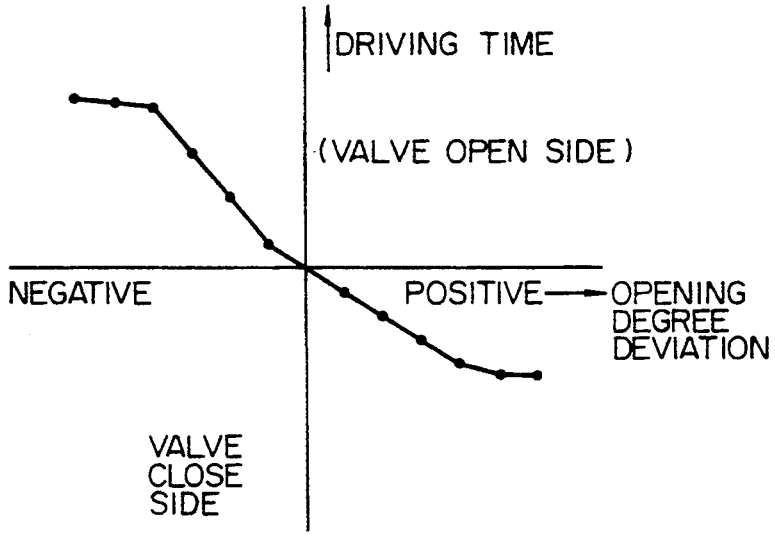
FIG. 6 is a graph showing the relation between the deviation of the opening degree and the driving time of the actuator.

When the performing conditions for the control of the target rotational speed are not satisfied in step 102, a deviation between the target opening degree of the throttle valve 3 and the actual opening degree is calculated in step 105. As shown in FIG. 5, the target opening degree has previously been stored as a map by the correlation with the temperature of the engine cooling water while setting the shift position of the transmission to a parameter. The driving time of the actuator 2 is calculated by the relation shown in FIG. 6 stored in the map in step 106 in accordance with the deviation calculated and the drive instruction signal 11*a* is generated.

Figure 7:
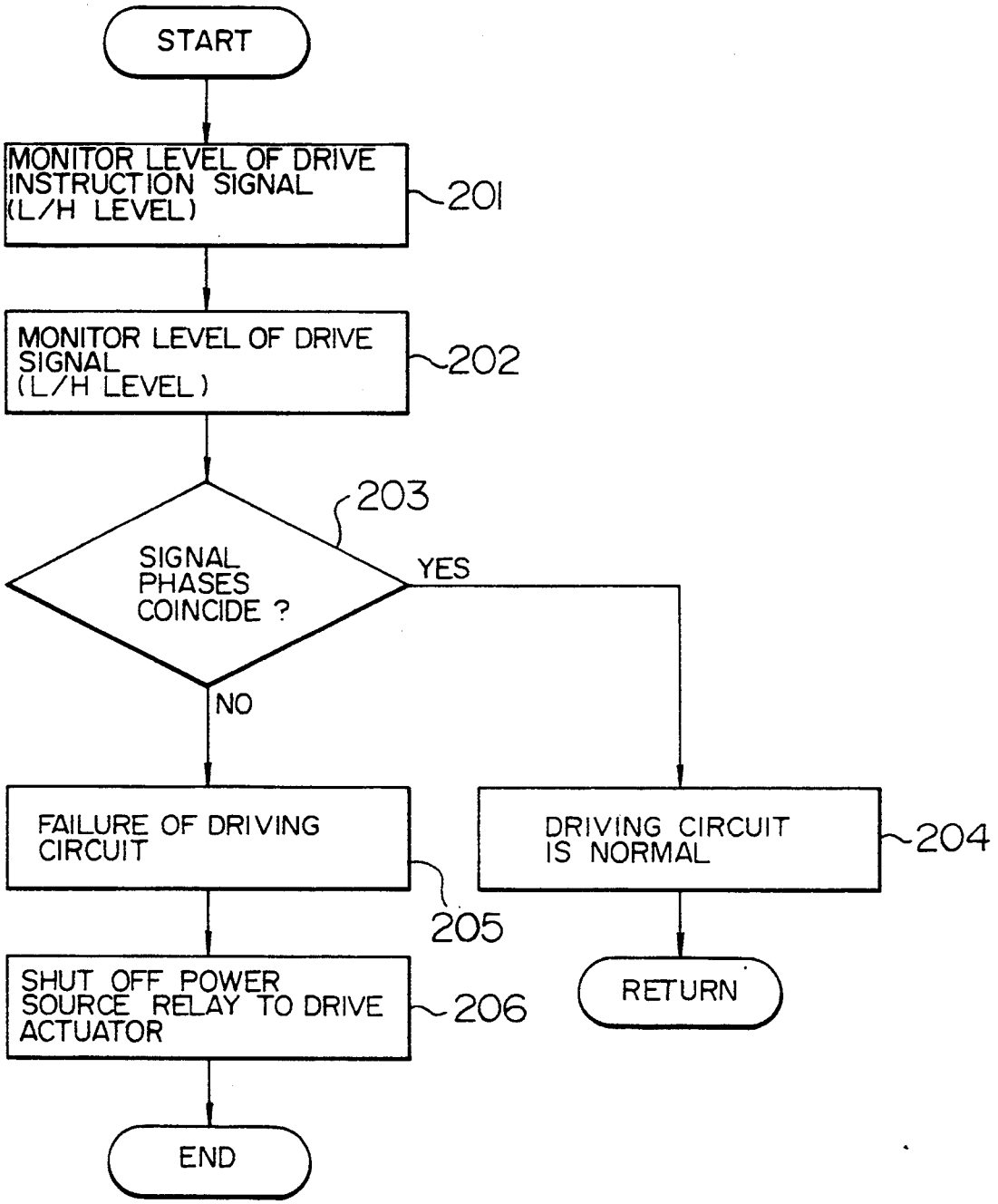
FIG. 7 is a flowchart for determination of a failure in a CPU.

FIG. 7 shows a failure detecting procedure of the driving circuit 13 which is executed by the CPU 11. In step 201, the signal level of the drive instruction signal 11*a* which is generated from the driving circuit 13 is detected. In step 202, the signal level of the drive signal 13*a* is known from an output of the driving circuit monitor 14. In step 203, a check is made to see if the phases of both of the signals 11*a* and 13*a* coincide or not. If YES, the driving circuit 13 is determined to be normal and the next processes are executed.

When the signal phases differ in step 203, it is determined that a failure has occurred in the driving circuit 13 in step 205. The excitation of the relay coil 61 is stopped and the relay contact 62 is opened, thereby stopping the current supply to the actuator 2 (step 206). Even in the case where the drive signal 13*a* is not released due to, for example, a short-circuit in the driving circuit 13 or the like by such a procedure, the current supply to the actuator is also forcedly shut off.

Figure 9:
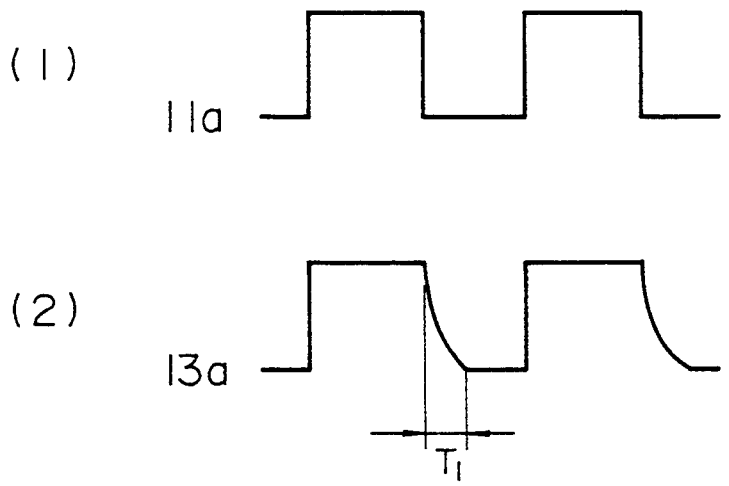
FIG. 9 is a signal waveform diagram.

In case of comparing the phases, as shown in FIG. 9, since the signal 13*a* is not immediately set to the "0" level due to an inertia of the actuator 2 even when the signal 11*a* trails, the phase detection is stopped for a period of time $T_1$.

Figure 8:
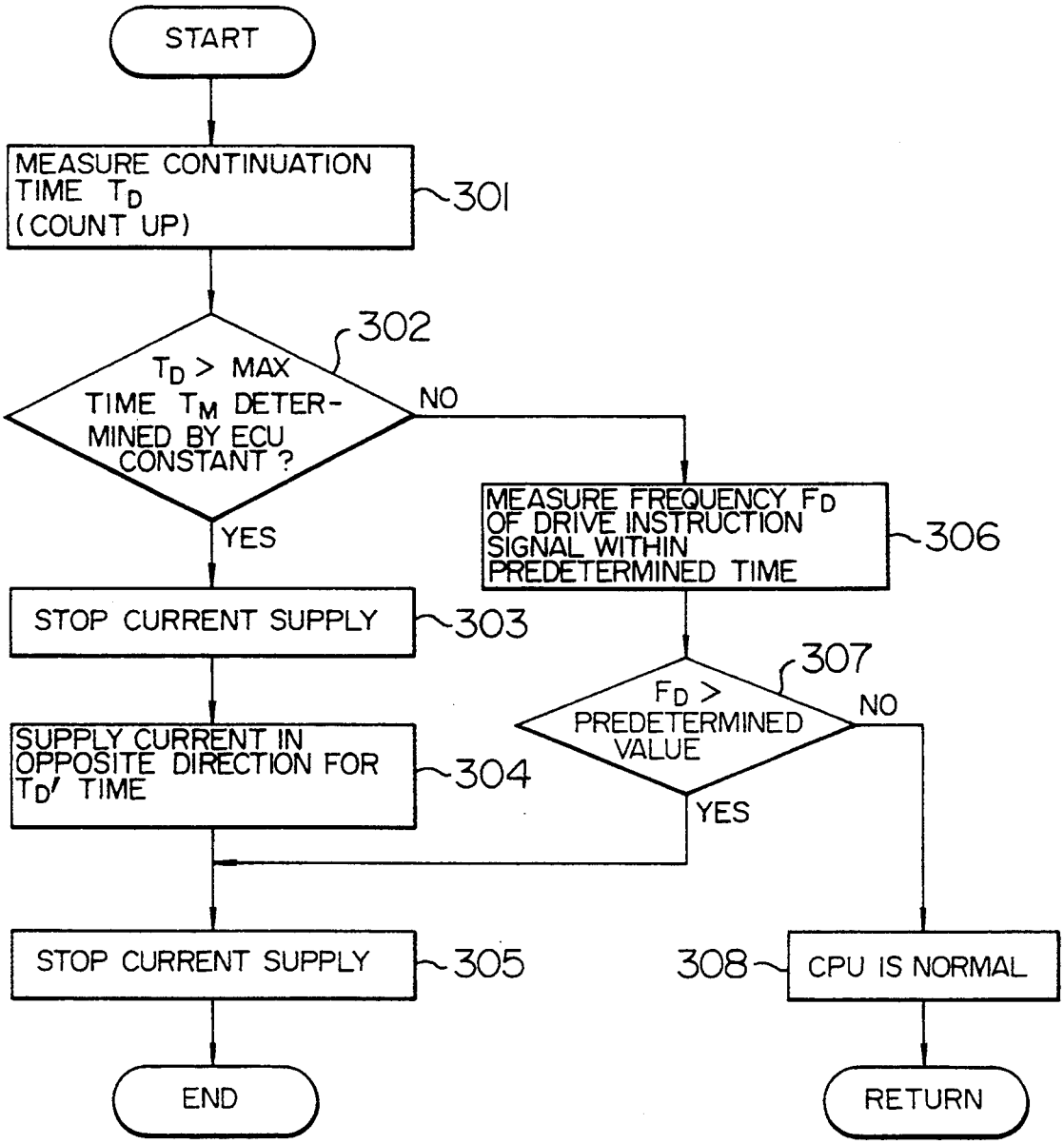
FIG. 8 is a flowchart for determination of a failure in a backup IC.

FIG. 8 shows a failure detecting procedure of the CPU 11 which is executed by the B/U IC 12. In step 301, the elapsed time $T_D$ of the drive instruction signal 11*a* is measured. When $T_D$ exceeds the predetermined time period $T_M$ (step 302), it is determined that a failure has occurred in the CPU. The current supply to the actuator 2 is stopped (step 303). In steps 304 and 305, a reverse rotation signal to the motor of the actuator 2 is generated for a time $T_d'$ that is equal to a time to return the amount deviated for the elapsed time $T_D$ of the drive instruction signal 11*a* just before the occurrence of a failure to a state before it is deviated. Due to this, the opening degree of the throttle valve 3 is returned to the opening degree just before occurance of the failure.

Figure 10:
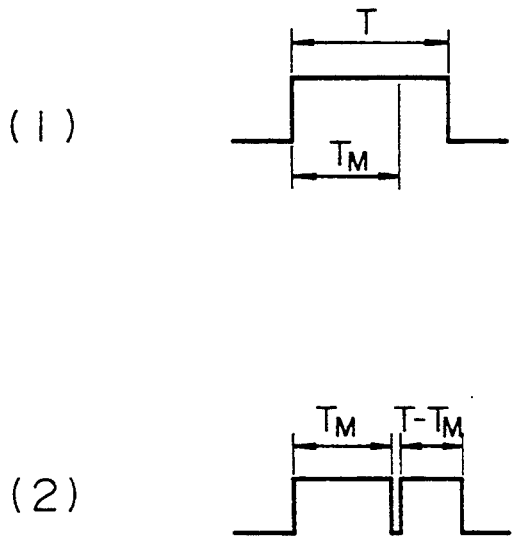
FIG. 10 is a signal waveform diagram.

As shown in FIG. 10(1), in dependence on control state, it is necessary to generate pulses for a time T exceeding the time period $T_M$. In this case, however, as shown in FIG. 10(2), the generation of the signal is interrupted for a short time (for example, about 0.5 msec) during which the motor operation is not influenced in the time $T_M$, thereby avoiding an erroneous determination.

When the continuation time of the drive instruction signal 11*a* doesn't exceed the predetermined time period $T_M$ in step 302, the number of leading edges of the signal 11*a* is counted in step 306, thereby measuring the frequency $F_D$. When the frequency $F_D$ exceeds a predetermined value (step 307), it is determined that a failure has occurred in the CPU 11, so that the current supply to the actuator 2 is stopped (step 305). When the frequency $F_D$ lies within a normal range, the CPU is decided to be normal and the processing routine advances to the next process (step 308).

Such a determination of the failure is executed in a time interval (for instance, 20 msec) short enough to prevent a runaway of the throttle valve.

As mentioned above, according to the throttle valve control apparatus of the invention, a failure of the driving system including a control computer can be certainly detected and the runaway of the throttle valve can be prevented.

What is claimed is:

1. A throttle valve control apparatus for detecting an idling state of an engine of a vehicle and for controlling a throttle valve to a predetermined opening degree upon idling, comprising:

actuator means for opening or closing the throttle valve;

driving means for generating a drive signal to said actuator means in a pulse-like manner; and failure determining means for determining the occurrence of a failure of said driving means when a frequency of said drive signal exceeds a predetermined value, said predetermined value being representative of a drive signal frequency of said apparatus in a non-failure state.

2. A throttle valve control apparatus for detecting an idling state of an engine of a vehicle and for controlling a throttle valve to a predetermined opening degree upon idling, comprising:

actuator means for opening or closing said throttle valve;

driving means for generating a drive signal to said actuator means in a pulse-like manner;

drive instructing means for generating a drive instruction signal to said driving means; and failure determining means for comparing phases of said drive instruction signal and said drive signal and for determining the occurrence of a failure of said driving means when said drive instruction signal phase and said drive signal phase do not coincide.

3. A throttle valve control apparatus for detecting an idling state of an engine of a vehicle and for controlling a throttle valve to a predetermined opening degree upon idling, comprising:

actuator means for opening or closing said throttle valve;

driving means for generating a drive signal to said actuator means in a pulse-like manner; and failure determining means for determining the occurrence of a failure of said driving means when a pulse length of the drive signal exceeds a predetermined value and for generating to the actuator means a reverse operation signal of a pulse length that is equal to a length to return an amount deviated by said pulse length to a state before it is deviated, said predetermined value representing a duration of a drive signal from said apparatus in a non-failure state.

4. An apparatus according to claim 1, wherein an elapsed time of the drive signal of said driving means is set to a value which is equal to or larger than a period corresponding to a determination frequency of said failure determining means and which is equal to or less than a second predetermined value longer than said first predetermined value.

5. An apparatus according to claim 2, wherein said failure determining means and said drive instructing means include processing procedures in a microcomputer, and said apparatus further has back-up means for determining the occurrence of a failure of said microcomputer when a pulse length of said drive instruction signal exceeds a predetermined value, said predetermined value representing a duration of a drive signal from said apparatus in a non-failure state, and for stopping a current supply to said actuator means responsive to said determination.

6. An apparatus according to claim 5, wherein the drive instruction signal of said drive instructing means is set to a value shorter than said predetermined value of said back-up means.

7. An apparatus according to claim 6, wherein said drive instructing means includes means for interrupting said drive instruction signal for a short time within said predetermined value when a time during which the pulse length of said drive instruction signal exceeds the predetermined value of said back-up means is needed.

8. An apparatus according to claim 6, wherein said back-up means includes means for supplying a reverse direction operation signal of a length corresponding to said predetermined value to said actuator means when it is determined that a failure has occurred in said microcomputer.

9. An apparatus according to claim 6, wherein said microcomputer further includes means, including a processing procedure, for stopping the operation of said driving means when said failure determining means determines the occurrence of a failure of said driving means.

10. An apparatus according to claim 6, wherein said back-up means further includes means for determining the occurrence of a failure of said driving means when a frequency of said drive instruction signal is equal to or higher than a predetermined maximum driving frequency even when the pulse length of said drive instruction signal doesn't exceed the predetermined value, said predetermined maximum driving frequency corresponding to a frequency of said drive instruction signal is in a non-failure state.

* * * * *